US009424796B2

(12) United States Patent
Liu

(10) Patent No.: US 9,424,796 B2
(45) Date of Patent: Aug. 23, 2016

(54) CIRCUIT FOR ELIMINATING SHUT DOWN IMAGE STICKING AND ARRAY SUBSTRATE COMPRISING THE CIRCUIT

(71) Applicants: HEFEI BOE OPTOELECTRONICS TECHNOLOGY CO., LTD., Hefei (CN); BOE TECHNOLOGY GROUP CO., LTD., Beijing (CN)

(72) Inventor: Rongcheng Liu, Beijing (CN)

(73) Assignees: HEFEI BOE Optoelectronics Technology Co., Ltd., Hefei (CN); BOE Technology Group Co., Ltd., Beijing (CN)

( * ) Notice: Subject to any disclaimer, the term of this patent is extended or adjusted under 35 U.S.C. 154(b) by 162 days.

(21) Appl. No.: 14/236,218

(22) PCT Filed: Jul. 2, 2013

(86) PCT No.: PCT/CN2013/078706
§ 371 (c)(1),
(2) Date: Jan. 30, 2014

(87) PCT Pub. No.: WO2014/169534
PCT Pub. Date: Oct. 23, 2014

(65) Prior Publication Data

US 2015/0029172 A1 Jan. 29, 2015

(30) Foreign Application Priority Data

Apr. 19, 2013 (CN) ..... 2013 1 0138533

(51) Int. Cl.
*G09G 3/36* (2006.01)
*G09G 3/20* (2006.01)

(52) U.S. Cl.
CPC ..... *G09G 3/3696* (2013.01); *G09G 3/20* (2013.01); *G09G 3/3611* (2013.01);

(Continued)

(58) Field of Classification Search
CPC ..... G09G 3/3696; G09G 3/3622; G09G 23/0251; G09G 2320/0257
USPC ..... 345/87, 212
See application file for complete search history.

(56) References Cited

U.S. PATENT DOCUMENTS 8,363,032 B2 * 1/2013 Yang ..... G06F 3/0412 345/174
2002/0149574 A1 * 10/2002 Johnson ..... G02F 1/133382 345/204

(Continued)

FOREIGN PATENT DOCUMENTS

CN 1801303 A 7/2006
CN 1845233 A 10/2006
CN 101174038 A 5/2008

OTHER PUBLICATIONS

International Search Report for International Application No. PCT/CN2013/078706, 11pgs.
Second Office action (Chinese language) issued by the State Intellectual Property Office ("SIPO") on Feb. 13, 2015, for application 201310138533.1, 4 pages.

(Continued)

*Primary Examiner* — Chanh Nguyen
*Assistant Examiner* — Daniel Duong
(74) *Attorney, Agent, or Firm* — Banner & Witcoff, Ltd.

(57) ABSTRACT

The present disclosure relates to a field of display technique, and particularly to a circuit and an array substrate for eliminating shutting-down image sticking, which may eliminate the image sticking generated after a display apparatus is shut down. The circuit comprises a charging module and a discharging module; the discharging module is connected with a first voltage terminal, and is used for storing charges under a control of a first voltage signal input from the first voltage terminal; the discharging module is connected with the charging module and a second voltage terminal, and is used for providing the charges stored by the charging module to gate lines under a control of a second voltage signal input from the second voltage terminal.

19 Claims, 4 Drawing Sheets

(52) U.S. Cl.
CPC ..... *G09G 3/3622* (2013.01); *G09G 3/3674* (2013.01); *G09G 2310/0245* (2013.01); *G09G 2310/0251* (2013.01); *G09G 2320/0257* (2013.01); *G09G 2330/027* (2013.01)

(56) References Cited

U.S. PATENT DOCUMENTS

| | | | | |
|---|---|---|---|---|
| 2008/0100331 | A1* | 5/2008 | Qi | G09G 3/3648 324/750.3 |
| 2013/0016035 | A1* | 1/2013 | Ikeda | H01L 27/14601 345/92 |
| 2013/0147697 | A1* | 6/2013 | Sung | G02F 1/136204 345/87 |

OTHER PUBLICATIONS

English translation of Second Office action (listed above) for application 201310138533.1, 4 pages.

English abstract for application CN 101174038A, listed above, 1 page.

First Office action (Chinese language) issued by the State Intellectual Property Office ("SIPO") on Sep. 26, 2014, for application 201310138533.1, 6 pages.

English translation of first Office action (listed above) for application 201310138511.1, 6 pages.

Oct. 20, 2015—International Preliminary Report on Patentability Appn PCT/CN2013/078706.

* cited by examiner

CIRCUIT FOR ELIMINATING SHUT DOWN IMAGE STICKING AND ARRAY SUBSTRATE COMPRISING THE CIRCUIT

CROSS REFERENCE TO RELATED APPLICATIONS

This application is based on International Application No. PCT/CN2013/078706 filed on Jul. 2, 2013, which claims priority to Chinese National Application No. 201310138533.1 filed on Apr. 19, 2013, the contents of which are incorporated herein by reference.

TECHNICAL FIELD

The present invention relates to a field of display technique, and particularly to a circuit for eliminating shut down image sticking and an array substrate comprising the circuit.

BACKGROUND

Currently, a Thin Film Transistor Liquid Crystal Display (referred to as a TFT-LCD briefly thereafter) is widely used in an electronics product which is closely related to people's daily life, such as a notebook computer, a mobile phone, a TV and the like. However, in general, a part of a previous image may remain when a power supply of the TFT-LCD is turned off, since charges may be accumulated in a liquid crystal capacitance between two counter electrodes after the display has displayed the image for a long time, and the accumulated charges can not be released immediately after the power supply is turned off, such that a part of the previous image remains after shutting-down.

SUMMARY

Embodiments of the present disclosure provide a circuit and an array substrate for eliminating shut down image sticking, which may eliminate the phenomenon of image sticking generated after a display apparatus is shut down.

Correspondingly, the embodiments of the present disclosure utilize solutions as follows.

In one aspect, there is provided a circuit for eliminating shut down image sticking, and the circuit comprises a charging module and a discharging module;

the discharging module is connected with a first voltage terminal, and is used for storing charges under a control of a first voltage signal input from the first voltage terminal; and the discharging module is connected with the charging module and a second voltage terminal, and is used for providing the charges stored by the charging module to gate lines as shutting-down under a control of a second voltage signal input from the second voltage terminal.

Optionally, the circuit further comprises an inputting module; and the inputting module is connected with the discharging module, and is used for outputting the second voltage signal to the second voltage terminal as shutting-down.

Optionally, the charging module comprises at least one group of charging units, each group of the charging units comprise a capacitor and a first switching unit; wherein:

the capacitor comprises a first electrode and a second electrode, and the first electrode of the capacitor is connected with a reference voltage terminal; and the first switching unit comprises a first control terminal, a first inputting terminal and a first outputting terminal, the first outputting terminal of the first switching unit is connected with the second electrode of the capacitor, and the first inputting terminal of the first switching unit is connected with the first control terminal.

Optionally, the first control terminal of the first switching unit in the each group of the charging units is further connected with the first voltage terminal.

Optionally, the charging module comprises N groups of the charging units, the first outputting terminal of the first switching unit in the ith group of the charging units is connected with the first inputting terminal of the first switching unit in the (i+1)th group of the charging units, and the first inputting terminal of the first switching unit in the first group of the charging units is connected with the first voltage terminal; wherein N is the number of the gate lines, and i is an integer greater than or equal to 1 and smaller than N.

Optionally, capacitance values of the first m capacitors are increased sequentially, and capacitance values of the remaining capacitors are equal to each other, and the capacitance value of each of the remaining capacitors is greater than the capacitance value of the mth capacitor, wherein m is an integer greater than zero and smaller than N.

Optionally, the discharging module comprises a plurality of second switching units; wherein each of the second switching units comprises: a first control terminal, a first inputting terminal and a first outputting terminal; the first control terminal of each second switching unit is connected with the second voltage terminal, the first outputting terminal of the each second switching unit is connected with one gate line, the first inputting terminals of at least two second switching units are connected with the first outputting terminal of the first switching unit in one group of the charging units, and the first inputting terminals of the remaining second switching units are connected with the first outputting terminals of the first switching units in other groups of the charging units, respectively.

Optionally, the discharging module comprises a plurality of second switching units; wherein, each of the second switching units comprises: a first control terminal, a first inputting terminal and a first outputting terminal; the first control terminal of the jth second switching unit is connected with the second voltage terminal, the first inputting terminal of the jth second switching unit is connected with the first outputting terminal of the first switching unit in the jth group of the charging units, the first outputting terminal of the jth second switching unit is connected with the one gate line, and each of the gate lines is connected with one of the second switching units, wherein j is an integer being greater than zero and smaller than N.

Optionally, the discharging module further comprises a plurality of third switching units; wherein, the third switching unit comprises a first control terminal, a first inputting terminal and a first outputting terminal; wherein the first control terminal of the ith third switching unit is connected with the second voltage terminal, the first inputting terminal of the ith third switching unit is connected with the first outputting terminal of the ith second switching unit, and the first outputting terminal of the ith third switching unit is connected with the first outputting terminal of the (i+1)th second switching unit.

In another aspect, there is provided an array substrate comprising the circuit for eliminating shut down image sticking described above.

Optionally, in a case that the charging module of the circuit for eliminating shut down image sticking comprises a plurality of capacitors, the first electrodes of all of the capacitors are connected with each other, and the first electrodes are connected with a common electrode line on the array substrate.

Optionally, effective relative areas between the first electrodes and the second electrodes of the first m capacitors in the plurality of capacitors increase sequentially, and effective relative areas between the first electrodes and the second electrodes of the remaining capacitors are equal to each other, and the effective relative area of each of the remaining capacitors is greater than the effective relative area between the first electrode and the second electrode of the mth capacitor.

The embodiments of the present disclosure provide a circuit and an array substrate for eliminating shut down image sticking, the circuit comprises the charging module and the discharging module, wherein the charging module is used for storing the charges under the control of the first voltage signal input from the first voltage terminal, and the discharging module is used for providing the charges stored by the charging module to the gate lines as shutting-down under the control of the second voltage signal input from the second voltage terminal. Thus, the discharging module may provide the charges stored by the charging module to the gate lines as shutting-down under the control of the second voltage signal in order to ensure all of thin film transistors to be turned on, so that the residual charges stored in the liquid crystal capacitors may be released rapidly, which may eliminate the phenomenon of the image sticking generated after the liquid crystal display apparatus is shut down.

BRIEF DESCRIPTION OF THE DRAWINGS

In order to explain solutions in embodiments of the present disclosure or the prior art more clearly, drawings required as describing the embodiments of the present disclosure or the prior art will be introduced briefly below. Obviously, the drawings described below only illustrate some embodiments of the present disclosure, and those ordinary skilled in the art may obtain other drawings according to these drawings without paying any inventive labors.

Reference Signs in Drawings charging module-10; discharging module-20; inputting module-30; gate line-GL; capacitor-C, first electrode-101, second electrode-102; first switching unit-T1, first control terminal-201, first inputting terminal-202, first outputting terminal-203; second switching unit-T2, first control terminal-301, first inputting terminal-302, first outputting terminal-303; third switching unit-T3, first control terminal-401, first inputting terminal-402, first outputting terminal-403; reference voltage terminal-V0; first voltage terminal-V1; second voltage terminal-V2.

DETAILED DESCRIPTION

Thereafter, solutions of embodiments of the present disclosure will be described clearly and completely in connection with drawings of the embodiments of the present disclosure; obviously, the described embodiments are only some and not all of the embodiments of the present disclosure. Any other embodiments obtained by those ordinary skilled in the art based on the embodiments of the present disclosure without paying inventive labors should fall into the scope sought for protection in the present disclosure.

Figure 1:
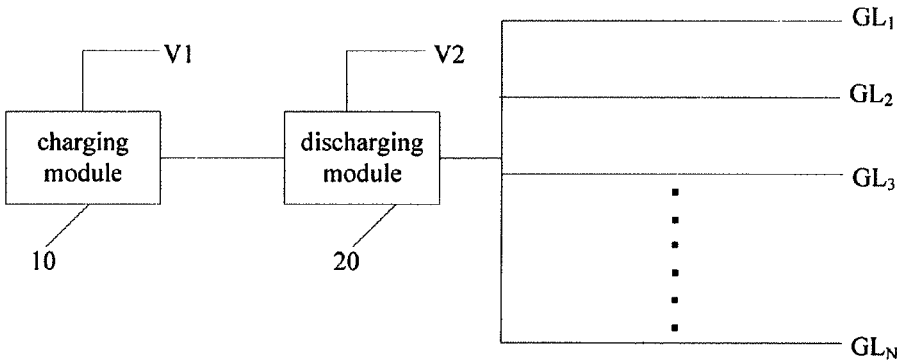
FIG. 1 is a block diagram illustrating a circuit for eliminating shut down image sticking according to the embodiments of the present disclosure.
Figure 2:
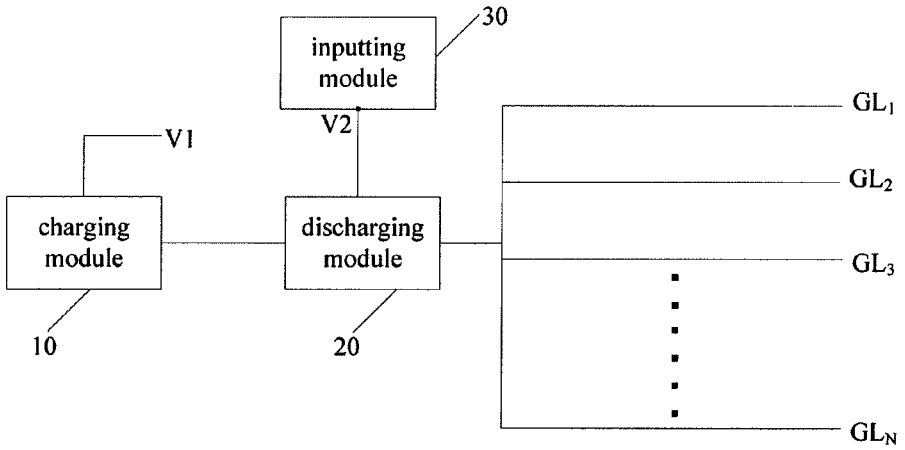
FIG. 2 is a block diagram illustrating another circuit for eliminating shut down image sticking according to the embodiments of the present disclosure.

The embodiments of the present disclosure provide a circuit for eliminating shut down image sticking, as illustrated in FIGS. 1 and 2, and the circuit comprises a charging module 10 and a discharging module 20; wherein the charging module 10 is connected with a first voltage terminal V1, and is used for storing charges under a control of a first voltage signal input from the first voltage terminal V1; the discharging module 20 is connected with the charging module 10 and a second voltage terminal V2, and is used for providing the charges stored by the charging module 10 to gate lines as shutting-down under a control of a second voltage signal input from the second voltage terminal V2.

In an example, for the second voltage terminal, the second voltage signal input therefrom may be non-constant, and the present disclosure is not limited thereto.

As an example, in the embodiments of the present disclosure, the second voltage signal input from the second voltage terminal V2 may be combined with an Xon function (a control signal which enables thin film transistors in all of rows to be turned on as shutting-down) in the prior art. That is to say, the Xon function is enabled as shutting-down, and the discharging module 20 provides the charges stored by the charging module 10 to the gate lines under the control of the second voltage signal input from the second voltage terminal V2, in order to ensure all of the thin film transistors connected with the gate lines to be turned on; the Xon function is disenabled as starting-up, and the discharging module 20 does not provide the charges stored by the charging module 10 to the gate lines under the control of the second voltage signal input from the second voltage terminal V2. No definition is made for the first voltage signal input from the first voltage terminal V1, as long as it can turn on all of the thin film transistors connected with gates.

Furthermore, the Xon function, the first voltage terminal, the second voltage terminal and the like may be integrated into a gate driving IC, or may be used separately, and the embodiments of the present disclosure are not limited thereto.

The embodiments of the present disclosure provide a circuit for eliminating shut down image sticking, wherein the circuit comprises the charging module and the discharging module, the charging module is used for storing the charges under the control of the first voltage signal input from the first voltage terminal, and the discharging module is used for providing the charges stored by the charging module to the gate lines as shutting-down under the control of the second voltage signal input from the second voltage terminal. Thus, the discharging module may provide the charges stored by the charging module to the gate lines as shutting-down under the control of the second voltage signal in order to ensure all of thin film transistors to be turned on, so that the residual charges stored in the liquid crystal capacitors may be released rapidly, which may eliminate the phenomenon of the image sticking generated after the liquid crystal display apparatus is shut down.

In an example, as illustrated in FIG. 2, the circuit for eliminating shut down image sticking may further comprise an inputting module 30; and the inputting module 30 is connected with the discharging module 20, and is used for outputting the second voltage signal to the second voltage terminal V2 as shutting-down.

As an example, an Xon function module may be integrated into the inputting module 30, and the Xon function is enabled as shutting-down, so that the inputting module 30 is controlled to input the second voltage signal to the second voltage terminal V2, the discharging module 20 is controlled to provide the charges stored by the charging module 10 to the gate lines. Of course, the Xon function is disabled as starting-up, and the inputting module 30 may also input the second voltage signal to the second voltage terminal V2, but this second voltage signal can not control the discharging module 20 to provide the charges stored by the charging module 10 to the gate lines.

In an example, the charging module 10 comprises at least one group of charging units, each group of the charging units comprise a capacitor and a first switching unit.

In an example, the capacitor comprises a first electrode 101 and a second electrode 102, wherein the first electrode 101 of the capacitor is connected with a reference voltage terminal V0. The first switching unit comprises a first control terminal 201, a first inputting terminal 202 and a first outputting terminal 203, wherein the first outputting terminal 203 of the first switching unit is connected with the second electrode 102 of the capacitor, the first inputting terminal 202 of the first switching unit is connected with the first voltage terminal V1.

Of course, the first control terminal 201 of the first switching unit may also be connected with the first voltage terminal V1, as long as the first switching unit is enabled to be always turned on.

It should be noted that the number of the capacitors and the number of the first switching units may be same or different, and the specific number may be set depending on the actual situation, as long as they may realize a function for storing the charges in the charging unit, and the embodiments of the present disclosure are not limited thereto. Furthermore, the number of the charging units is not limited thereto.

In a case that the charging module 10 comprises at least one group of charging units, and that each group of the charging units comprise a capacitor and a first switching unit, the discharging module 20 comprises a plurality of second switching units.

In an example, each of the second switching units comprises: a first control terminal 301, a first inputting terminal 302 and a first outputting terminal 303; the first control terminal 301 of the second switching unit is connected with the second voltage terminal V2, the first inputting terminal 302 of the second switching unit is connected with the first outputting terminal 203 of the first switching unit, the first outputting terminal 303 of the second switching unit is connected with one gate line, and each gate line is connected with one second switching unit.

In particular, when the Xon function is enabled, the second voltage signal output from the second voltage terminal V2 may control all of the second switching units to be turned on.

The number of the second switching units is the number of the gate lines. For example, there may be 768 gate lines in total for a display apparatus with a resolution of 1024×768, and the number of the second switching units is also 768.

It should be noted that the number of the first switching units or of the capacitors may be different from the number of the second switching units, that is, the first outputting terminal 203 of one first switching unit may be connected with the first inputting terminals 302 of several second switching units; of course, the number of the first switching units or of the capacitors may also be the same as the number of the second switching units, and the embodiments of the present disclosure are not limited thereto, as long as a voltage output from the first outputting terminal 303 of each second switching unit enables all of the thin film transistors on the corresponding gate line connected therewith to be turned on.

Embodiment 1

Figure 3:
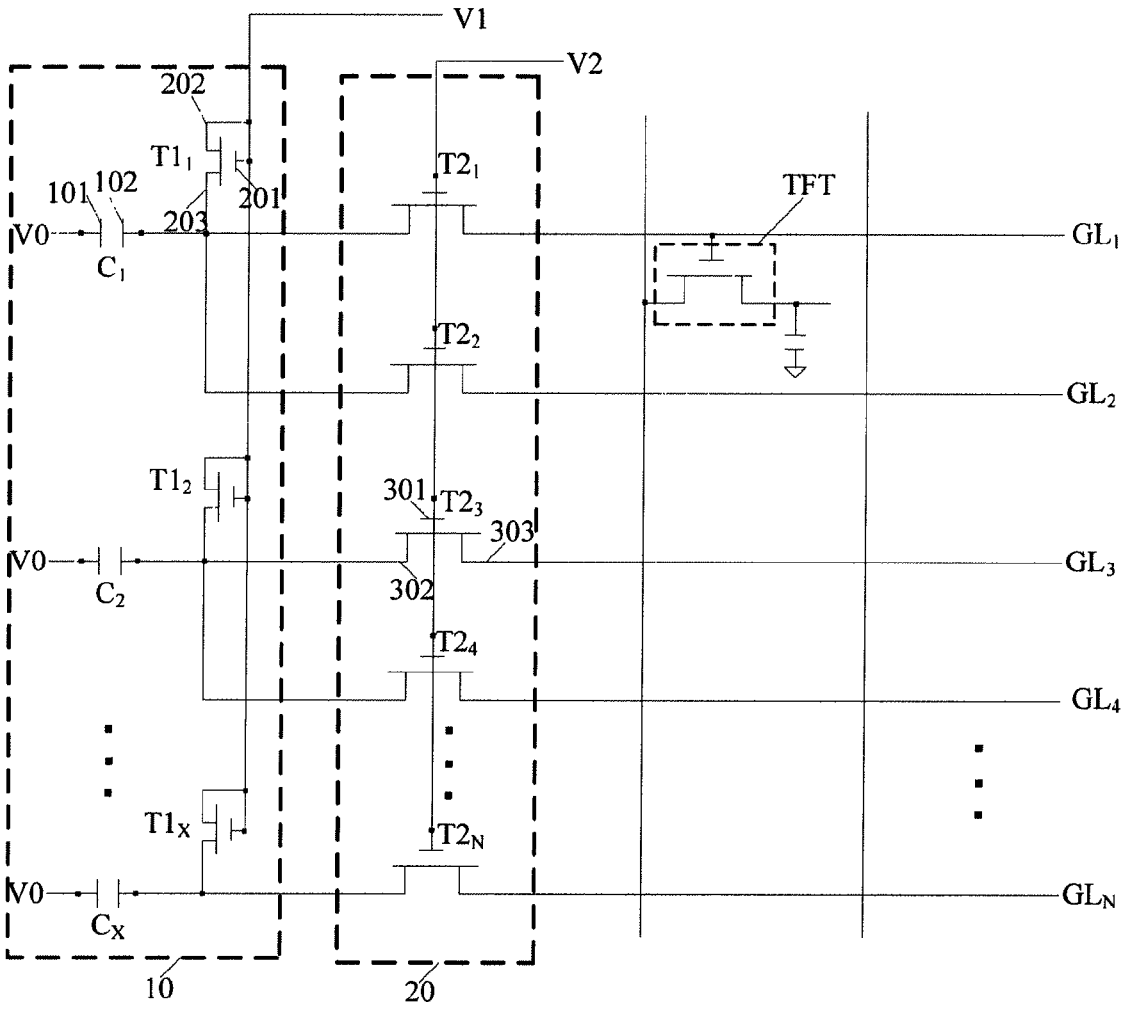
FIG. 3 is an exemplary view illustrating a circuit for eliminating shut down image sticking according to an Embodiment 1 of the present disclosure.

The embodiment of the present disclosure provides a circuit for eliminating shut down image sticking, and as illustrating in FIG. 3, the circuit comprises a plurality of capacitors $C_1, C_2, \ldots, C_X$, a plurality of first switching units $T1_1$, $T1_2, \ldots T1_X$, and a plurality of second switching units $T2_1$, $T2_2, T2_3, T2_4, \ldots, T2_N$; N is the number of gate lines, and X is a positive integer being smaller than N.

In an example, each of the capacitors comprises a first electrode 101 and a second electrode 102, and the first electrode 101 of the capacitor is connected with a reference voltage terminal V0.

Each of the first switching units comprises a first control terminal 201, a first inputting terminal 202 and a first outputting terminal 203; the first outputting terminal 203 of the first switching unit is connected with the second electrode 102 of the capacitor, and the first control terminal 201 and the first inputting terminal 202 of the first switching unit are connected with the first voltage terminal V1.

Herein, as illustrated in FIG. 3, for example, the first control terminal 201 and the first inputting terminal 202 of a first one of the first switching units $T1_1$ are connected with the first voltage terminal V1, and the first outputting terminal 203 of the first one of the first switching units $T1_1$ is connected with the second electrode 102 of the first capacitor $C_1$; the first control terminal 201 and the first inputting terminal 202 of a second one of the first switching units $T1_2$ are connected with the first voltage terminal V1, and the first outputting terminal 203 of the second one of the first switching units $T1_2$ is connected with the second electrode 102 of the second capacitor $C_2$; and so on.

The first one of the first switching units $T1_1$ and the first capacitor $C_1$ form a group of charging unit; the second one of the first switching units $T1_2$ and the second capacitor $C_2$ form another group of charging unit, and so on.

Each of the second switching units comprises: a first control terminal 301, a first inputting terminal 302 and a first outputting terminal 303; the first control terminal 301 of the second switching unit is connected with the second voltage terminal V2, the first inputting terminal 302 of the second switching unit is connected with the first outputting terminal 203 of the first switching unit, the first outputting terminal 303 of the second switching unit is connected with one gate line, and each gate line is connected with one second switching unit $T2_N$.

For example, as illustrated in FIG.3, for example, the first inputting terminals 302 of a first one of the second switching units $T2_1$ and a second one of the second switching units $T2_2$ are both connected with the first outputting terminal 203 of a first one of the first switching units $T1_1$; the first inputting terminals 302 of a third one of the second switching units $T2_3$ and a fourth one of the second switching units $T2_4$ are both connected with the first outputting terminal 203 of the second one of the first switching unit $T1_2$; for the remaining second switching units, the first inputting terminals of at least one second switching units may be connected with the first outputting terminal of one first switching unit, for example, and details are omitted herein.

It should be noted that the embodiments of the present disclosure are not limited thereto, and those skilled in the art may configure the circuit suitably depending on the actual situation, as long as the charges stored in any one capacitor may enable all of the TFTs on the gate line electrically connected with the second electrode of this capacitor to be turned on.

Thus, the first voltage signal provided from the first voltage terminal V1 may turn on all of the first switching units $T1_1, \ldots, T1_X$ and charge the capacitor $C_1, \ldots, C_X$ connected with the corresponding first outputting terminal 203 as starting-up (the Xon function is disabled). The second voltage signal provided from the second voltage terminal V2 may turn on all of the second switching units $T2_1, \ldots, T2_N$ and the charged capacitors $C_1, \ldots, C_X$ may maintain all of the TFTs connected with the gate lines $GL_1, \ldots, GL_N$ being turned on as shutting-down (the Xon function is enabled), so that the residual charges stored in the liquid crystal capacitors may be released rapidly. Further, a problem that a capability of a gate driving IC in terms of turning on all of the TFTs simultaneously is insufficient in the prior art may be avoided, since the respective TFTs connected with each gate line are turned on by the first voltage signal and the voltages for turning on the gates of the TFTs are maintained as consistent by the capacitor electrically connected with this gate line, respectively.

Figure 4:
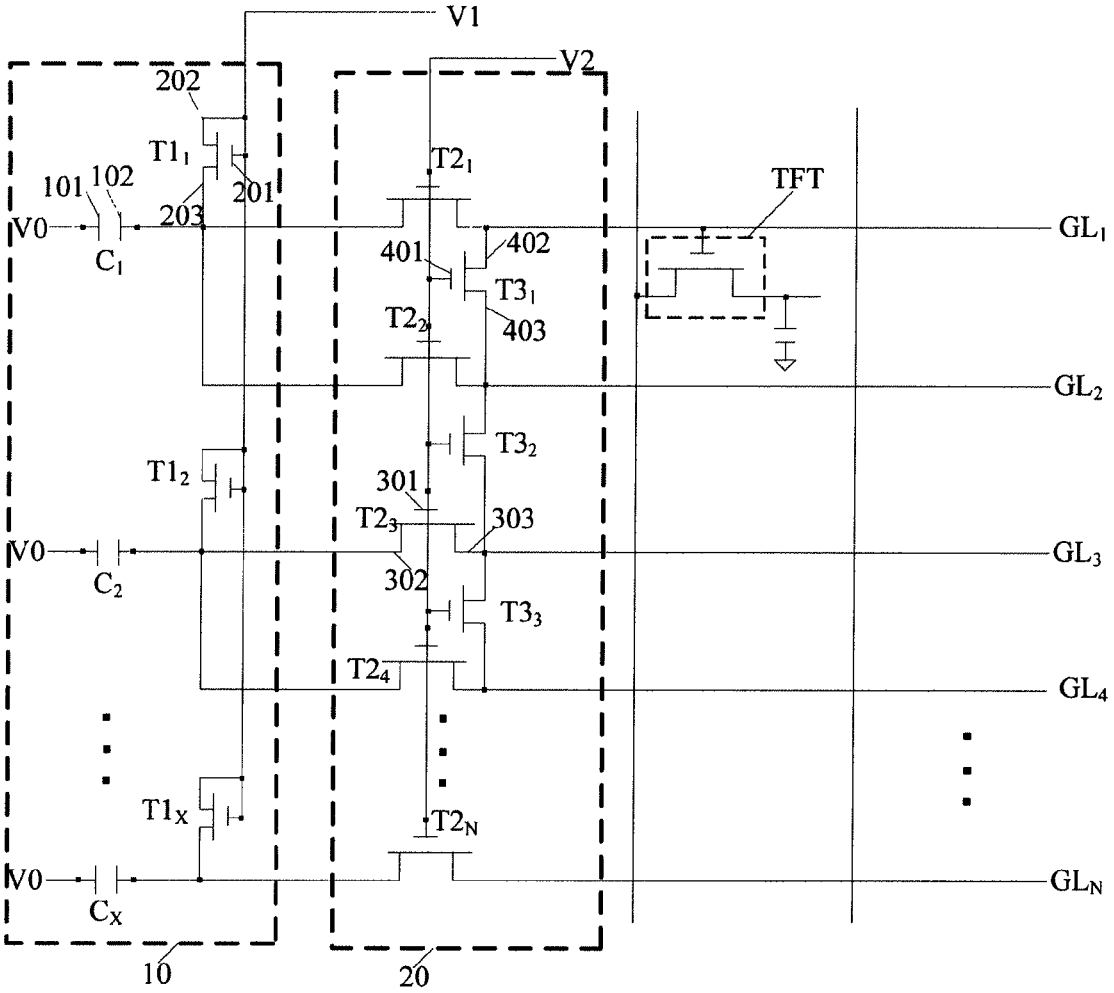
FIG. 4 is an exemplary view illustrating a circuit for eliminating shut down image sticking, which comprises a plurality of third switching units, according to the embodiments of the present disclosure.

In a further example, as illustrated in FIG. 4, the circuit further comprises a plurality of third switching units in a case that the discharging module 20 comprises a plurality of second switching units.

In an example, each of the third switching units comprises a first control terminal 401, a first inputting terminal 402 and a first outputting terminal 403; the first control terminal 401 of the third switching unit is connected with the second voltage terminal V2, the first inputting terminal 402 of the third switching unit is connected with the first outputting terminal 303 of the second switching unit, and the first outputting terminal 403 of the third switching unit is connected with an adjacent gate line, and the third switching unit is disposed between adjacent gate lines.

It should be noted that disposing the third switching unit between adjacent gate lines means a case as follows: the first inputting terminal 402 of the third switching unit is connected with the first outputting terminal 303 of the second switching unit, that is, the first inputting terminal 402 of the third switching unit is connected with one gate such as $GL_i$, and the first outputting terminal 403 of the third switching unit is connected with an adjacent gate line, that is with a gate line adjacent to the gate line $GL_i$, for example with the gate line $GL_{i+1}$. At the same time, there is no definition for the number of the third switching units disposed between the adjacent gate lines, as long as they can control a connection/disconnection between the adjacent gate lines.

In particular, as illustrated in FIG.4, the first inputting terminal 402 of a first one of the third switching units $T3_1$ is connected with the first outputting terminal 303 of the first one of the second switching units $T2_1$, the first outputting terminal 403 of the first one of the third switching units $T3_1$ is connected with the first outputting terminal 303 of the second one of the second switching units $T2_2$; the first inputting terminal 402 of the second one of the third switching units $T3_2$ is connected with the first outputting terminal 303 of the second one of the second switching units $T2_2$, the first outputting terminal 403 of the second one of the third switching units $T3_2$ is connected with the first outputting terminal 303 of the third one of the second switching units $T2_3$; for the third one of the third switching units $T3_3$ and subsequent third switching units, the case is similar.

Therefore, for each of the second switching units, its first outputting terminal 303 can be still ensured to output a voltage through an effect of the third switching units even if the first outputting terminals 303 of some second switching units fail to output a voltage due to failures in part of the circuit, which may increase a reliability of the circuit.

Furthermore, the charging module 10 may comprise N capacitors and N first switching units in a case that the charging module comprises at least one group of charging units and each group of the charging units comprise a capacitor and a second switching unit.

In an example, the first outputting terminal 203 of the ith first switching unit is connected with the second electrode 102 of the ith capacitor. The first control terminal 201 of the ith first switching unit and the first inputting terminal 202 of the ith first switching unit are connected with the first voltage terminal V1, and the first control terminal 201 and the first inputting terminal of the (i+1)th first switching unit are connected with the first outputting terminal 203 of the ith first switching unit, wherein N is the number of the gate lines, and i is a positive integer being greater than or equal to 1 and smaller than N.

Thus, the first voltage signal provided from the first voltage terminal V1 may turn on the first switching units $T1_1, T1_2, \ldots, T1_i, \ldots, T1_X$ sequentially and charge the capacitors $C_1, C_2, \ldots, C_i, \ldots, C_X$ connected with the corresponding first outputting terminal 203 sequentially as starting-up (the Xon function is disabled). The second voltage signal provided from the second voltage terminal V2 may turn on all of the second switching units $T2_1, T2_2, \ldots, T2_i, \ldots, T2_N$ and the charged capacitors $C_1, C_2, \ldots, C_i, \ldots, C_X$ may maintain all of the TFTs connected with the gate lines $GL_1, GL_2, \ldots, GL_i, \ldots, GL_N$ being turned on as shutting-down (the Xon function is enabled), so that the residual charges stored in the liquid crystal capacitors may be released rapidly and the phenomenon of image sticking generated after the liquid crystal display apparatus is shut down is eliminated. Further, a problem that a capability of a gate driving IC in terms of turning on all of the TFTs simultaneously is insufficient in the prior art may be avoided, since the respective TFTs connected with each gate line are turned on by the first voltage signal and the voltages for turning on their gates are maintained as consistent by the capacitors electrically connected with this gate line, respectively.

Embodiment 2

Figure 5:
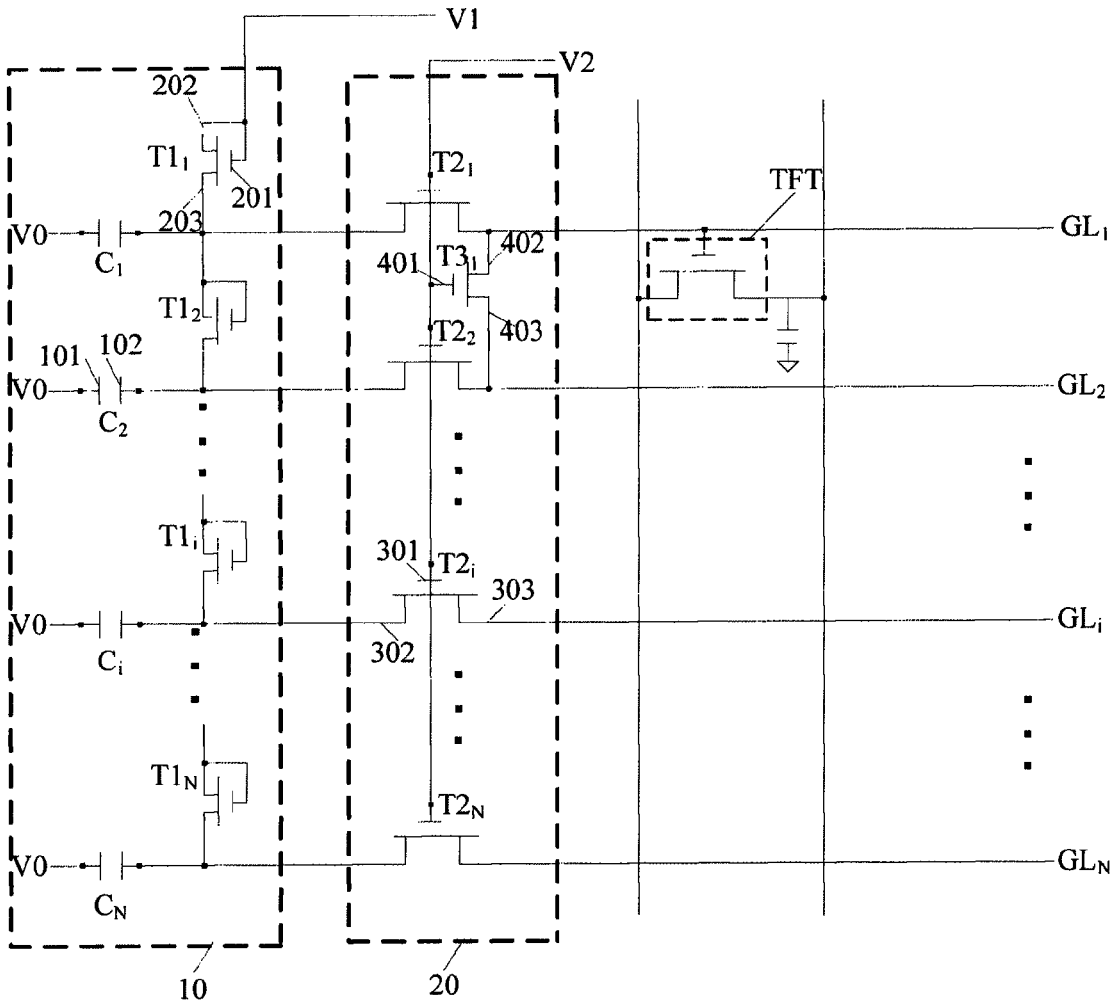
FIG. 5 is an exemplary view illustrating a circuit for eliminating shut down image sticking according to an Embodiment 2 of the present disclosure.

The embodiment of the present disclosure provides a circuit for eliminating shut down image sticking, as illustrating in FIG. 5, the circuit comprises a plurality of capacitors $C_1, C_2, \ldots, C_i, C_N$, a plurality of first switching units $T1_1, T1_2, \ldots, T1_i, \ldots, T1_N$, a plurality of second switching units $T2_1, T2_2, \ldots, T2_i, \ldots, T2_N$, and a plurality of third switching units $T3_1, T3_2, \ldots, T3_i, \ldots, T3_{N-1}$; N is the number of gate lines, and i is an integer being greater than 1 and smaller than N.

In an example, each of the capacitors $C_i$ comprises a first electrode 101 and a second electrode 102, and the first electrode 101 of the capacitor is connected with a reference voltage terminal V0.

Each of the first switching units $T1_i$ comprises a first control terminal 201, a first inputting terminal 202 and a first outputting terminal 203. In particular, the first control terminal 201 and the first inputting terminal 202 of the first one of the first switching units $T1_1$ are connected with the first voltage terminal V1, the first outputting terminal 203 of the first one of the first switching units $T1_1$ is connected with the second electrode 102 of the first capacitor $C_1$; the first control terminal 201 and the first inputting terminal 202 of the second one of the first switching units $T1_2$ are connected with the first outputting terminal 203 of the first one of the first switching units $T1_1$, the first outputting terminal 203 of the second one of the first switching units $T1_2$ is connected with the second electrode 102 of the second capacitor $C_2$; the first control terminal 201 and the first inputting terminal 202 of the ith first switching unit $T1_i$ are connected with the first outputting terminal 203 of the (i−1)th first switching unit $T1_{i-1}$, the first outputting terminal 203 of the ith first switching unit $T1_i$ is connected with the second electrode 102 of the ith capacitor $C_i$; and the rest is similar.

Each of the second switching units $T2_i$ comprises: a first control terminal 301, a first inputting terminal 302 and a first outputting terminal 303. In particular, the first control terminal 301 of the first one of the second switching units $T2_1$ is connected with the second voltage terminal V2, the first inputting terminal 302 of the first one of the second switching units $T2_1$ is connected with the first outputting terminal 203 of the first one of the first switching units $T1_1$, the first outputting terminal 303 of the first one of the second switching units $T2_1$ is connected with a first gate line $G_{L1}$; the first control terminal 301 of the second one of the second switching units $T2_2$ is connected with the second voltage terminal V2, the first inputting terminal 302 of the second one of the second switching units $T2_2$ is connected with the first outputting terminal 203 of the second one of the first switching units $T1_2$, the first outputting terminal 303 of the second one of the second switching units $T2_2$ is connected with a second gate line $G_{L2}$; the first control terminal 301 of the ith second switching unit $T2_i$ is connected with the second voltage terminal V2, the first inputting terminal 302 of the ith second switching unit $T2_i$ is connected with the first outputting terminal 203 of the ith first switching unit $T1_i$, the first outputting terminal 303 of the ith second switching unit $T2_i$ is connected with an ith gate line $G_{Li}$; and the rest is similar.

Each of the third switching units $T3_i$ comprises a first control terminal 401, a first inputting terminal 402 and a first outputting terminal 403. In particular, the first inputting terminal 402 and the first outputting terminal 403 of the first one of the third switching units $T3_1$ are connected with the first gate line $GL_1$ and the second gate line $GL_2$, respectively, the first control terminal 401 of the first one of the third switching units $T3_1$ is connected with the second voltage terminal V2; and the rest is similar.

Thus, the second voltage signal provided from the second voltage terminal V2 may turn on all of the second switching units and the third switching units, and the first voltage signal provided from the first voltage terminal V1 may turn on all of the TFTs connected with one gate line as shutting-down (the Xon function is enabled). Further, the charged capacitors $C_1$, $C_2, \ldots, C_N$ may maintain all of the TFTs connected with the gate lines $GL_1, GL_2, \ldots, GL_i, \ldots, GL_N$ being turned on.

In the embodiment of the present disclosure, the third switching units are also turned on when the second switching units are turned on, so that all of the gate lines are connected with each other, which may increase the reliability.

It is further considered that when this circuit is used for eliminating the shut down image sticking, if the first several capacitors have too large capacitance values, a significant increasing appears in a starting-up current at a moment of starting-up, therefore, as an example, the capacitance values of the first m capacitors increase sequentially, the capacitance values of the remaining capacitors are equal to each other, and the capacitance value of each of the remaining capacitors is greater than the capacitance value of the mth capacitor; wherein m is a positive integer being smaller than N. In an example, m is counted from a gate line scanned firstly in an order for scanning the gate lines.

That is to say, the capacitance values of the first m capacitors increase sequentially herein, and the capacitance values of the remaining capacitors from the (m+1)th capacitor are equal to each other, and the capacitance value of each of the remaining capacitors is greater than the capacitance value of the mth capacitor. Furthermore, the number of m and the capacitance values of the capacitors may be set suitably depending on the actual situation, and the embodiments of the present disclosure are not limited thereto.

For example, a predetermined number is 3, the capacitance values of the capacitors (that is, $C_1$, $C_2$, $C_3$) electrically connected with the first 3 gate lines (that is, $GL_1$, $GL_2$, $GL_3$) via the second switching units increase sequentially, and the capacitance values of the remaining capacitors are equal to each other, and the capacitance value of each of the remaining capacitors is greater than the capacitance value of $C_3$; wherein the capacitance value of the first capacitor $C_1$ electrically connected with the first gate line $GL_1$ via the first one of the second switching units $T2_1$ may be set to be charged fully within a ⅓period of time of a high level provided by the first voltage terminal V1.

Herein, the embodiment is only described by taking the first 3 gate lines in the order for scanning the gate lines as an example, but the embodiments of the present disclosure are not limited thereto.

It should be noted that all of the switching units in all of the embodiments of the present disclosure may be the thin film transistors, and the control terminal of the switching unit is a gate of the thin film transistor. In a case that the thin film transistor is N-type, the inputting terminal of the switching unit is a drain of the thin film transistor, and the outputting terminal of the switching unit is a source of the thin film transistor.

The embodiments of the present disclosure provide an array substrate comprising any one of the circuits for eliminating shutting-down image sticking described above.

In the array substrate according to the embodiments of the present disclosure, since the TFT connected with the each of gate line is turned on by the discharging module connected with the gate line, instead of drawing the charges on a Printed Circuit Board Assembly (PCBA) by an Anisotropic Conductive Film (ACF), so that a phenomenon of cutting-off of a joint due to a case in which gold particles in the ACF at the joint are burned down is avoided.

In a case that the charging module of the above circuit comprises a plurality of capacitors, since a first electrode of a common electrode is connected with a reference voltage terminal, the first electrodes 101 of all of the capacitors are connected with each other, and the first electrodes are connected with a common electrode line on the array substrate, by taking the case in which there exists a common electrode line for supplying power to the common electrode on the array substrate, into consideration. Thus technical processes may be saved when the array substrate is manufactured.

Taking a problem that none of the capacitors can not be charged because of defects in local if the second electrodes 102 of all capacitors are connected with each other into consideration, none of capacitors has the second electrode 102 thereof connected with each other in the embodiment of the present disclosure, that is to say, the second electrodes 102 of the capacitors are separated and have no electric connection relationship therebetween.

It is further considered that if the first several capacitors have too large capacitance values, it may lead to a significant increasing in a starting-up current at a moment of starting-up, therefore, as an example, the capacitance values of the first m capacitors increase sequentially, and the capacitance values of the remaining capacitors are equal to each other, and the capacitance value of each of the remaining capacitors is greater than the capacitance value of the mth capacitor;

wherein m is counted from a gate line scanned firstly in an order for scanning the gate lines.

Furthermore, the requirements on the capacitance values of the above capacitors may be satisfied by changing effective relative areas between the first electrode 101 and the second electrode 102 of the capacitor. That is to say, the effective relative areas between the first electrodes 101 and the second electrodes 102 of the first m capacitors increase sequentially, and the effective relative areas between the first electrodes 101 and the second electrodes 102 of the remaining capacitors are equal to each other, and the effective relative area of each of the remaining capacitors is greater than the effective relative area between the first electrode 101 and the second electrode 102 of the mth capacitor.

Figure 6:
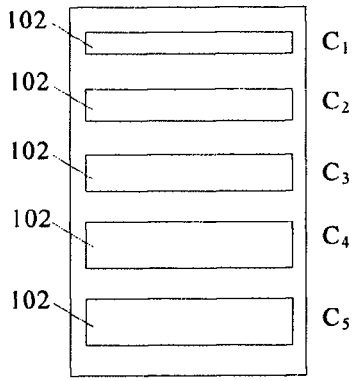
FIG. 6 is an exemplary view illustrating a structure of a capacitor according to the embodiments of the present disclosure.

For example, as illustrated in FIG. 6, given m of 3, in the order for scanning the gate lines, the first electrodes 101 of the capacitors (that is, $C_1$, $C_2$, $C_3$) electrically connected with the first 3 gate lines (that is, $GL_1$, $GL_2$, $GL_3$) via the second switching units are plates, and the areas of the second electrodes 102 of the capacitors (that is, $C_1$, $C_2$, $C_3$) increase sequentially.

In other words, the effective relative areas between the first electrodes and the second electrodes of the three capacitors increase sequentially, and the effective relative areas between the first electrodes 101 and the second electrodes 102 of the remaining capacitors (herein, $C_4$, $C_5$ for example) are equal to each other, and the effective relative area of each of the remaining capacitors is greater than the effective relative area between the first electrode 101 and the second electrode 102 of the $C_3$.

Taking a notebook computer product as an example, for the remaining capacitors, the area of the each second electrode may be set as 3 times of a size of a pixel area, and its first electrode is the plate (its area is greater than a sum of the areas of all second electrodes). Since a capacitance of each gate line is about 200 pF, which is equivalent to a capacitance having an area of 128000 $\mu m^2$ in a Gate Driver On Array (GOA) design, the area of one pixel (RGB) is about 200 $\mu m \times 200$ $\mu m = 40000$ $\mu m^2$, then it can be seen that a capacitance having 3 times of the size of the pixel area is equivalent to the capacitance of one gate line. Therefore, the circuit may provide a voltage of ½V to the each gate line separately to turn on the TFTs corresponding to sub-pixels when the Xon function is enabled.

Furthermore, the first electrode 101 of the capacitor may be disposed in a same layer with the gate lines, and the second electrode 102 may be disposed in a same layer with data lines. For the switching units, they may be the same TFTs connected with the gate lines, so that the switching units may be formed together with the TFTs connected with the gate lines when the array substrate is manufactured, which may reduce the technical process steps.

Further, the circuit for eliminating shutting-down image sticking is disposed on a side opposite to gate line leads on the array substrate, because wiring space on the side opposite to the gate line leads on the array substrate is relatively spare.

The embodiments of the present disclosure provide a liquid crystal display apparatus comprising the array substrate described above. The display apparatus may be a display device, such as a liquid crystal display, electric paper, etc, and any products or parts having a display function comprising such display devices, such as a TV, a digital camera, a mobile phone, a tablet computer and the like.

It should be noted that the liquid crystal display apparatus displays the images by controlling light transmittance through the liquid crystal by an electric field. The liquid crystal display apparatus is mostly classified into a vertical electric field driving type and a horizontal electric field driving type according a direction of the electric field for driving the liquid crystal. In the liquid crystal display apparatus of the vertical electric field driving type, the common electrodes and pixel electrodes, which are faced to each other, are disposed on a top substrate and a bottom substrate, respectively, and a vertical electric field between the common electrode and the pixel electrode is formed to drive the liquid crystal, such as the liquid crystal display apparatus of a Twist Nematic (TN) type, a Vertical Alignment (VA) type. In the liquid crystal display apparatus of the horizontal electric field driving type, the common electrodes and the pixel electrodes are disposed on the bottom substrate, and a horizontal electric field is formed between the common electrode and the pixel electrode to driving the liquid crystal, such as the liquid crystal display apparatus of an Advanced-Super Dimensional Switching (ADS) type, an In Plane Switch (IPS) type. The display apparatus according to the present disclosure may be any one of the above liquid crystal display apparatus.

The above descriptions only illustrate the specific embodiments of the present invention, and the protection scope of the present invention is not limited to this. Given the teaching as disclosed herein, variations or substitutions, which can easily occur to any skilled pertaining to the art, should be covered by the protection scope of the present invention. Thus, the protection scope of the present invention is defined by the claims.

What is claimed is:

1. A circuit for eliminating shutting-down image sticking, comprising a charging module and a discharging module; wherein the charging module is connected with a first voltage terminal, and stores charges under a control of a first voltage signal input from the first voltage terminal; and the discharging module is connected with the charging module and a second voltage terminal, and supplies the charges stored by the charging module to gate lines as shutting-down under a control of a second voltage signal input from the second voltage terminal;

wherein the charging module comprises a plurality of changing units each comprising a capacitor and a first switching unit;

wherein first switching units in the plurality of charging units are configured to receive the first voltage signal input from the first voltage terminal in parallel or in series so as to charge capacitors in the plurality of charging units respectively; and wherein capacitance values of a first m capacitors are increased sequentially, and capacitance values of the remaining capacitors are equal to each other, and a capacitance value of each of the remaining capacitors is greater than a capacitance value of a mth capacitor.

2. The circuit of claim 1, further comprising an inputting module;

the inputting module is connected with the discharging module, and outputs the second voltage signal to the second voltage terminal as shutting-down.

3. The circuit of claim 1, wherein:

the capacitor comprises a first electrode and a second electrode, and the first electrode of the capacitor is connected with a reference voltage terminal;

the first switching unit comprises a first control terminal, a first inputting terminal and a first outputting terminal, the first outputting terminal of the first switching unit is connected with the second electrode of the capacitor, and the first inputting terminal of the first switching unit is connected with the first control terminal thereof.

4. The circuit of claim 3, wherein the first control terminal of the first switching unit in each charging unit is further connected with the first voltage terminal.

5. The circuit of claim 4, wherein the discharging module comprises a plurality of second switching units; wherein each of the second switching units comprises: a first control terminal, a first inputting terminal and a first outputting terminal; the first control terminal of each second switching unit is connected with the second voltage terminal, the first outputting terminal of each second switching unit is connected with one gate line respectively, the first inputting terminals of at least two second switching units are connected with the first outputting terminal of the first switching unit in one charging unit, and the first inputting terminals of the remaining second switching units are connected with the first outputting terminals of the first switching units in other charging units, respectively.

6. The circuit of claim 5, wherein, the discharging module further comprises a plurality of third switching units; wherein, the third switching unit comprises a first control terminal, a first inputting terminal and a first outputting terminal; wherein the first control terminal of an ith third switching unit is connected with the second voltage terminal, the first inputting terminal of the ith third switching unit is connected with the first outputting terminal of the ith second switching unit, and the first outputting terminal of the ith third switching unit is connected with the first outputting terminal of a (i+1)th second switching unit.

7. The circuit of claim 3, wherein the charging module comprises N charging units, the first outputting terminal of the first switching unit in an ith charging unit is connected with the first inputting terminal of the first switching unit in the (i+1)th charging unit, and the first inputting terminal of the first switching unit in the first charging unit is connected with the first voltage terminal; wherein N is a number of the gate lines, and i is an integer being greater than or equal to 1 and being smaller than N.

8. The circuit of claim 7, wherein, the discharging module comprises a plurality of second switching units; wherein, each of the second switching units comprises: a first control terminal, a first inputting terminal and a first outputting terminal; the first control terminal of a jth second switching unit is connected with the second voltage terminal, the first inputting terminal of the jth second switching unit is connected with the first outputting terminal of the first switching unit in the jth charging unit, the first outputting terminal of the jth second switching unit is connected with one gate line, and each of the gate lines is connected with one of the second switching units, wherein j is an integer being greater than zero and smaller than N.

9. The circuit of claim 8, wherein, the discharging module further comprises a plurality of third switching units; wherein, the third switching unit comprises a first control terminal, a first inputting terminal and a first outputting terminal; wherein the first control terminal of an ith third switching unit is connected with the second voltage terminal, the first inputting terminal of the ith third switching unit is connected with the first outputting terminal of the ith second switching unit, and the first outputting terminal of the ith third switching unit is connected with the first outputting terminal of the (i+1)th second switching unit.

10. An array substrate comprising the circuit for eliminating shutting-down image sticking of claim 1.

11. The array substrate of claim 10, wherein in a case that the charging module of the circuit for eliminating shutting-down image sticking comprises a plurality of capacitors, first electrodes of all of the capacitors are connected with each other, and the first electrodes are connected with a common electrode line on the array substrate.

12. The array substrate of claim 11, wherein effective relative areas between the first electrodes and second electrodes of the first m capacitors in the plurality of capacitors increase sequentially, and effective relative areas between the first electrodes and the second electrodes of the remaining capacitors are equal to each other, and the effective relative area of each of the remaining capacitors is greater than the effective relative area between a first electrode and a second electrode of the mth capacitor.

13. The array substrate of claim 10, in the circuit for eliminating shutting-down image sticking, wherein:

the capacitor comprises a first electrode and a second electrode, and the first electrode of the capacitor is connected with a reference voltage terminal;

the first switching unit comprises a first control terminal, a first inputting terminal and a first outputting terminal, the first outputting terminal of the first switching unit is connected with the second electrode of the capacitor, and the first inputting terminal of the first switching unit is connected with the first control terminal thereof.

14. The array substrate of claim 13, in the circuit for eliminating shutting-down image sticking, the first control terminal of the first switching unit in each charging unit is further connected with the first voltage terminal.

15. The array substrate of claim 14, in the circuit for eliminating shutting-down image sticking, the discharging module comprises a plurality of second switching units; wherein each of the second switching units comprises: a first control terminal, a first inputting terminal and a first outputting terminal; the first control terminal of each second switching unit is connected with the second voltage terminal, the first outputting terminal of each second switching unit is connected with one gate line respectively, the first inputting terminals of at least two second switching units are connected with the first outputting terminal of the first switching unit in one charging unit, and the first inputting terminals of the remaining second switching units are connected with the first outputting terminals of the first switching units in other charging units, respectively.

16. The array substrate of claim 15, in the circuit for eliminating shutting-down image sticking, the discharging module further comprises a plurality of third switching units; wherein, the third switching unit comprises a first control terminal, a first inputting terminal and a first outputting terminal; wherein the first control terminal of an ith third switching unit is connected with the second voltage terminal, the first inputting terminal of the ith third switching unit is connected with the first outputting terminal of the ith second switching unit, and the first outputting terminal of the ith third switching unit is connected with the first outputting terminal of a (i+1)th second switching unit.

17. The array substrate of claim 13, in the circuit for eliminating shutting-down image sticking, the charging module comprises N charging units, the first outputting terminal of the first switching unit in an ith charging unit is connected with the first inputting terminal of the first switching unit in the (i+1)th charging unit, and the first inputting terminal of the first switching unit in the first charging unit is connected with the first voltage terminal; wherein N is a number of the gate lines, and i is an integer being greater than or equal to 1 and being smaller than N.

18. The array substrate of claim 17, in the circuit for eliminating shutting-down image sticking, the discharging module comprises a plurality of second switching units; wherein, each of the second switching units comprises: a first control terminal, a first inputting terminal and a first outputting terminal; the first control terminal of a jth second switching unit is connected with the second voltage terminal, the first inputting terminal of the jth second switching unit is connected with the first outputting terminal of the first switching unit in the jth charging unit, the first outputting terminal of the jth second switching unit is connected with one gate line, and each of the gate lines is connected with one of the second switching units, wherein j is an integer being greater than zero and smaller than N.

19. The array substrate of claim 18, in the circuit for eliminating shutting-down image sticking, the discharging module further comprises a plurality of third switching units; wherein, the third switching unit comprises a first control terminal, a first inputting terminal and a first outputting terminal; wherein the first control terminal of an ith third switching unit is connected with the second voltage terminal, the first inputting terminal of the ith third switching unit is connected with the first outputting terminal of the ith second switching unit, and the first outputting terminal of the ith third switching unit is connected with the first outputting terminal of the (i+1)th second switching unit.

* * * * *